US005779175A

United States Patent [19]

Shirahase

[11] Patent Number: 5,779,175

[45] Date of Patent: Jul. 14, 1998

[54] CORDING REEL DEVICE

[76] Inventor: Reiji Shirahase, 2-2-8-701, Shinmachi, Toride-Shi, Ibaraki, Japan

[21] Appl. No.: 849,841

[22] PCT Filed: Jun. 28, 1996

[86] PCT No.: PCT/JP96/01797

§ 371 Date: Jun. 18, 1997

§ 102(e) Date: Jun. 18, 1997

[87] PCT Pub. No.: WO97/19093

PCT Pub. Date: May 29, 1997

[30] Foreign Application Priority Data

Oct. 25, 1995 [JP] Japan ..... 7-277967

[51] Int. Cl.[6] ..... B65H 75/38

[52] U.S. Cl. ..... 242/388.1

[58] Field of Search ..... 242/388.1, 395, 242/407

[56] References Cited

U.S. PATENT DOCUMENTS

| | | | |
|---|---|---|---|
| 1,186,131 | 6/1916 | Replogle | 242/388.1 |
| 1,692,517 | 11/1928 | Replogle | 242/388.1 |
| 2,565,339 | 8/1951 | Anderson | 242/388.1 |
| 2,865,071 | 12/1958 | Clemens | 242/388.1 |
| 2,952,420 | 9/1960 | Von Hoorn | 242/388.1 |
| 2,991,523 | 7/1961 | Del Conte | 242/388.1 |
| 3,782,654 | 1/1974 | Kasa | 242/388.1 |
| 3,809,331 | 5/1974 | Gaul | 242/388.1 |
| 4,390,142 | 6/1983 | Cheng | 242/388.1 |
| 4,466,581 | 8/1984 | Hill | 242/388.1 |
| 5,351,907 | 10/1994 | Hartmann | 242/388.1 |

FOREIGN PATENT DOCUMENTS

| | | | |
|---|---|---|---|
| 1.464.060 | 11/1966 | France | 242/388.1 |
| 2 305 292 | 8/1974 | Germany | 242/388.1 |
| 2-38275 | 2/1990 | Japan . | |
| 299927 | 11/1928 | United Kingdom | 242/388.1 |
| 994143 | 6/1965 | United Kingdom | 242/388.1 |

*Primary Examiner*—John P. Darling

*Attorney, Agent, or Firm*—Pollock, Vande Sande & Priddy

[57] ABSTRACT

A cording reel device for winding up a cording of an electronic appliance from a section thereof intermediate its opposite ends. A first constraint plate is divided to define a cording insertion slot, with two divided halves of the plate being integrally connected together by a connecting portion. Coupling shaft segments are engaged with a circular hole in a second constraint plate to couple together the two constraint plates for relative rotation. Reel shaft segments outstand from the first constraint plate outside of the coupling shaft segments. An annular frame member is interposed between and along the outer peripheries of the constraint plates and affixed integrally to the second constraint plate. The frame member is formed with opposed inlet/outlets. In use, with the opposite ends of the insertion slot aligned with the inlet/outlets, an intermediate section of a cording is threaded through the slot between the opposed inlet/outlets, and then relative rotation of the constraint plates will reel in the cording section.

22 Claims, 9 Drawing Sheets

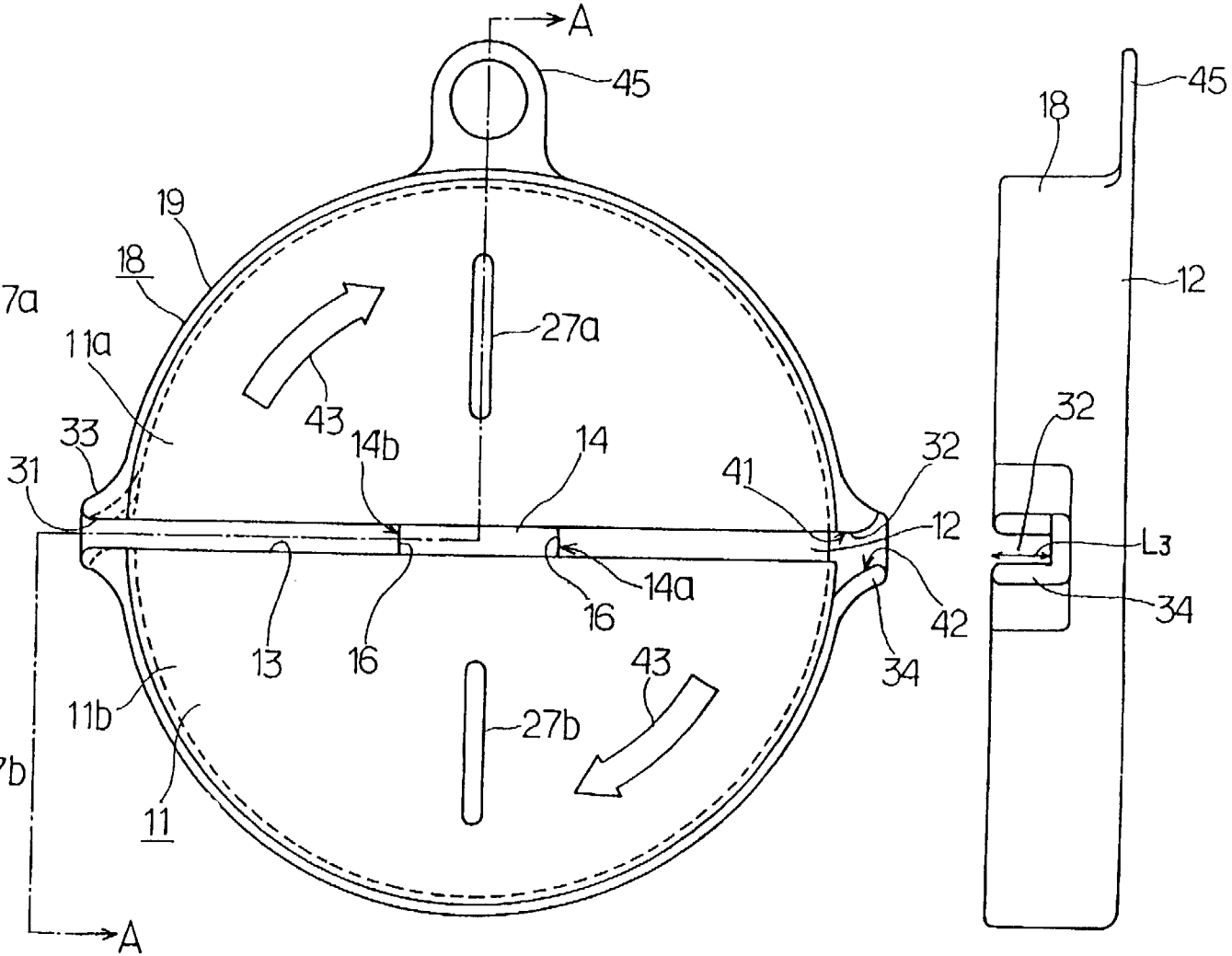
FIG. 3
FIG. 1
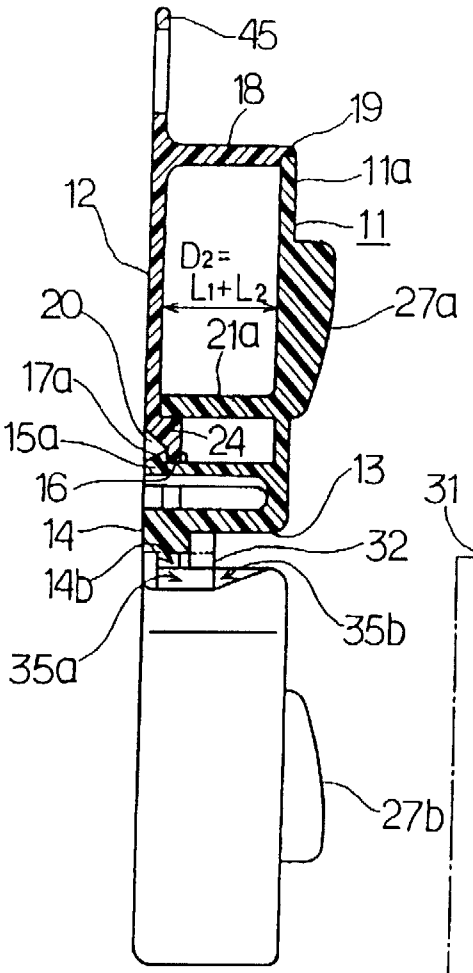
FIG. 2

CORDING REEL DEVICE

TECHNICAL FIELD

This invention relates to a cording reel device for extendibly winding up a cording including power cords, signalling cords and ear phone cords of various electronic appliances for home and office uses such as telephones, stereo sets, television sets, tape recorders, word processors, personal computers and the like as well as a cording including strings and cords as used with various pieces of equipment other than electric appliances.

BACKGROUND ART

The cording attached to various electronic appliances has heretofore been relatively overlong for the purpose of enhancing the freedom in locating the appliances. When users purchase a cording for their own use as well, they generally tend to buy an overlong cording so that the location of installation of the appliance may be changed later. Consequently, in the condition where electronic appliances are actually installed and used, the floor is flooded with extra lengths of the cording, which may possibly be caught by a man's foot, may interfere with cleaning the floor and are not nice to look at. In addition, where a plurality of electronic appliances are installed closely to each other, the associated cords were sometimes entangled with each other. In view of this, excessive lengths of cording have heretofore been put together and tied with a string.However, such operation is rather cumbersome, and especially in case the locations of the electronic appliances are relatively frequently changed for use, it is troublesome to bundle and tie and untie each time. At any rate, excessive lengths of cording are unsightly even though they are tied together.

It is an object of the invention to provide a cording reel device which overcomes the foregoing problems.

It is another object of the invention to provide a cording reel device which is easy to operate.

It is still another object of the invention to provide a cording reel device which is simple in construction and requires fewer component parts, and which is easy to manufacture and hence may be produced at low costs.

DISCLOSURE OF THE INVENTION

According to a first aspect of the invention, a first constraint plate is divided by a cording insertion slot into two halves which are integrally connected together by a connecting portion of U-shaped cross section. A pair of reel shaft segments are attached integrally to the first constraint plate on opposite sides of the connecting portion. A second constraint plate is coupled in opposed facing relation with the first constraint plate such that they may be relatively rotated about the reel shaft segments. An annular frame member is interposed between and generally along the outer peripheries of the first and second constraint plates and affixed integrally to the outer periphery of one of the constraint plates. The annular frame member is formed with first and second inlet/outlets for introducing and withdrawing a cording on opposite sides of the connecting portion.

According to a second aspect of the invention, a pair of opposed coupling shaft segments are provided to extend up from the interior surface of a first constraint plate at its center. A pair of reel shaft segments extend up from the interior surface of the first constraint plate outside of the coupling shaft segments, respectively. A second constraint plate is removably and rotatably coupled at its central portion with the free ends of the pair of coupling shaft segments. An annular frame member is interposed between and generally along the outer peripheries of the first and second constraint plates and affixed integrally to the outer periphery of one of the constraint plates. The annular frame member is formed with first and second inlet/outlets for introducing and withdrawing a cording on opposite sides of the coupling shaft segments.

In either of the first and second aspects of the invention, the first inlet/outlet is formed as spanning the first and second constraint plates while the second inlet/outlet is formed as extending from one of the two constraint plates to approximately the midpoint of the spacing between the two constraint plates. Further, the first inlet/outlet is formed with guide surfaces for guiding a cording from that one of the two constraint plates to which the second inlet/outlet is adjoining to the other of constraint plates.

In the first aspect of the invention, the coupling shaft segments are outstanding integrally from the interior surface of the first constraint plate between the connecting portion and the corresponding reel shaft segments, and the second constraint plate is rotatably engaged with the ends of these coupling shaft segments. In the first and second aspects of the invention having such coupling shaft segments, the coupling shaft segments are formed on the outer surfaces of their free ends with pawls configured to couple with the outer surfaces of the periphery of a central circular hole in the second constraint plate with the axial end face of the annular frame member in opposing contact with the interior surface of the constraint plate to which the annular frame member is not joined such that the first and second constraint plates are rotatably engaged with each other.

BRIEF DESCRIPTION OF THE DRAWINGS

FIG. 1 is a front view illustrating an embodiment of the first aspect of the invention;

FIG. 2 is a cross-sectional view taken along the line A—A in FIG. 1;

FIG. 3 is a side view seen from the right side of the drawing of FIG. 1;

BEST MODE FOR CARRYING OUT THE INVENTION

Figure 4:
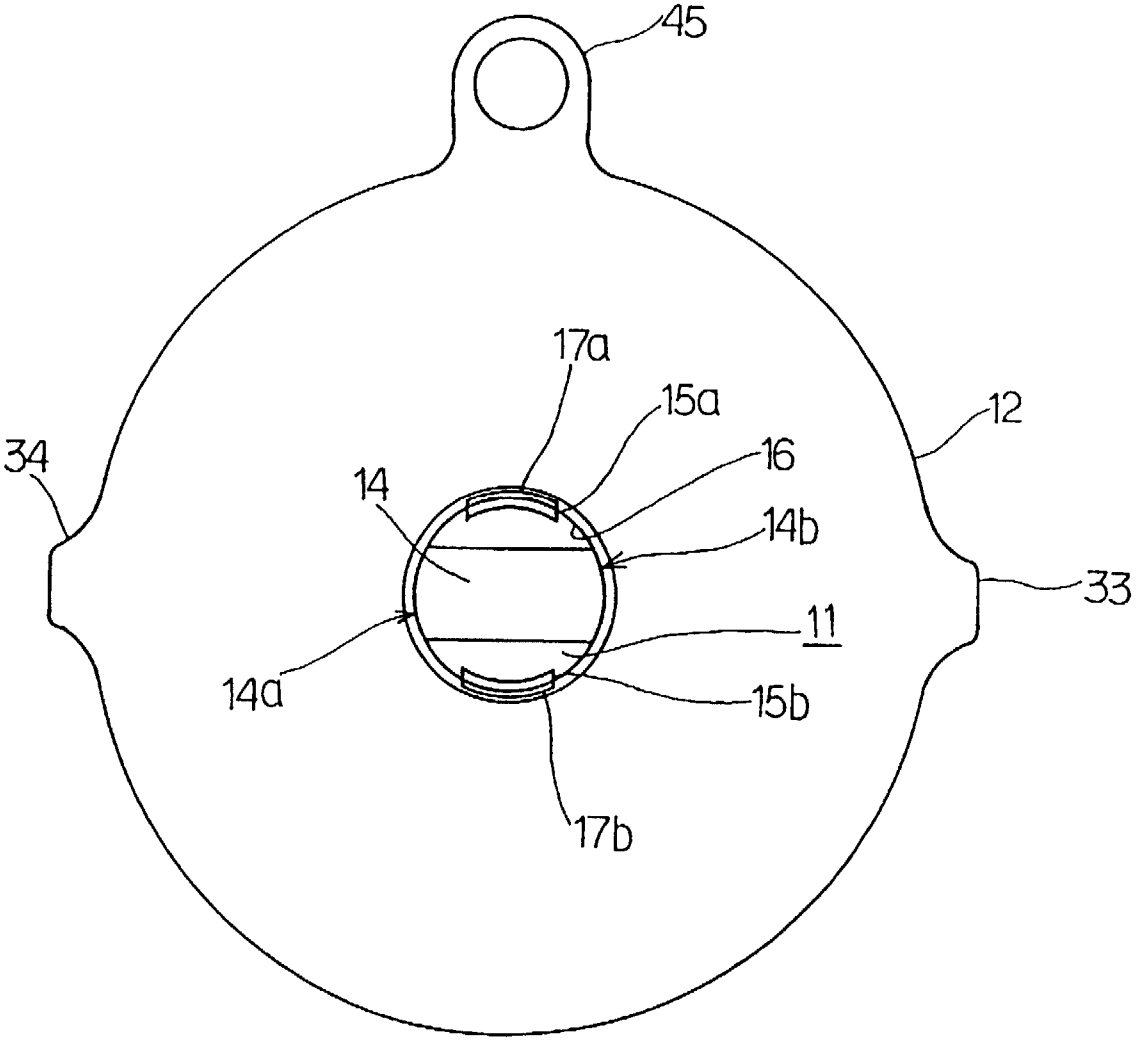
FIG. 4 is a rear view seen from the back side of the drawing of FIG. 1.
Figure 6:
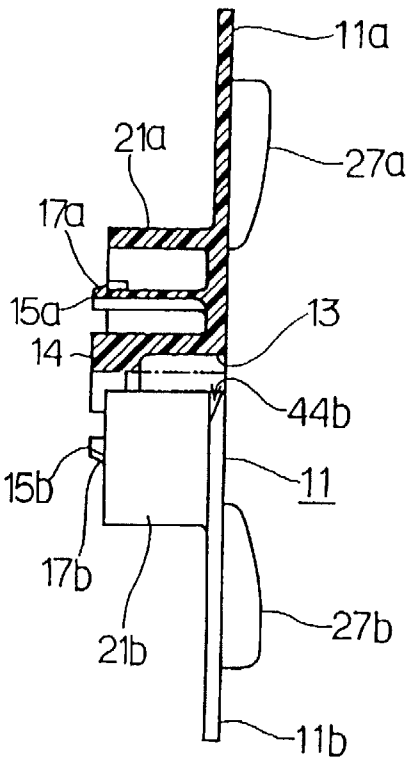
FIG. 6 is a cross-sectional view taken along the line A—A in FIG. 5.
Figure 9:
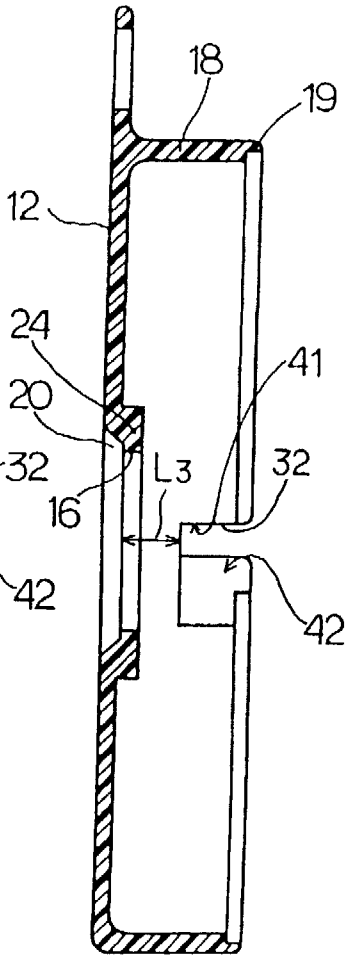
FIG. 9 is a cross-sectional view taken along the line A—A in FIG. 8.

An embodiment of the first aspect of the invention is shown in FIGS. 1–3. A first disc-like constraint plate 11 and an opposed second disc-like constraint plate 12 are engaged with each other for relative rotation. As shown in FIGS. 1, 2 and 6, the first constraint plate 11 is divided by a cording insertion slot 13 extending along the center line thereof into two plate sections 11a and lib which are integrally connected together by a connecting portion 14 of U-shaped cross section. More specifically, the end faces of the opposed legs of the U-shape of the connecting portion 14 are connected integrally with the interior surfaces of the plate sections 11*a* and 1*b* near the midpoint of the respective edges defining the cording insertion slot 13. It is thus seen that the bight portion between the opposed legs of the U-shape of the connecting portion 14 form a portion of the cording insertion slot 13. Coupling shaft segments 15*a* and 15*b* protrude up integrally from the plate sections 11*a* and 11*b*, respectively on opposite sides of and adjacent to the connecting portion 14. These coupling shaft segments 15*a* and 15*b* are located at equal distances from the center of axis of the first constraint plate 11. As shown in FIG. 4, the second constraint plate 12 is formed at its center with a circular hole 16. It is seen in FIGS. 2 and 4 that pawls 17*a*, 17*b* projecting integrally from the outside surfaces at the free ends of the coupling shaft segments 15*a*, 15*b* are adapted to engage with the outer surfaces of the periphery of the circular hole 16. The opposite ends 14*a*, 14*b* of the connecting portion 14 longitudinally of the cording insertion slot 13 are configured to form a part of a cylindrical surface in sliding contact with the inner peripheral surface of the circular hole 16. As shown in FIGS. 2 and 9, that portion of the second constraint plate 12 through which the circular hole 16 is formed has a recess 20 indented from the exterior surface of the second constraint plate 12 such that the outer ends of the coupling shaft segments 15*a*, 15*b* do not extend out beyond the exterior surface of the second constraint plate 12. Defined between the pawls 17*a*, 17*b* of the coupling shaft segments 15*a*, 15*b* and the peripheral wall of the recess 20 are spaces for allowing one to grasp the pawls 17*a*, 17*b* between the user's finger tips to move them toward each other.

Figure 5:
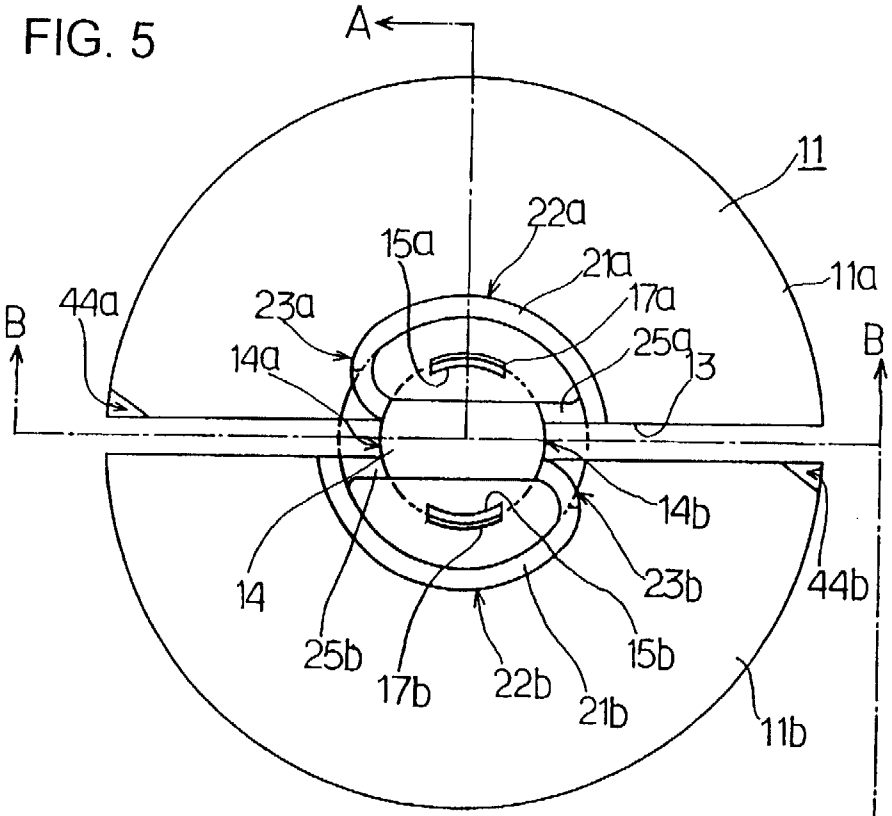
FIG. 5 is a rear view illustrating a portion including the first constraint plate 11 in FIG. 1.

As shown in FIGS. 1 and 2, an annular frame member 18 is interposed between and along the outer peripheries of the first and second constraint plates 11, 12 and is formed integrally with the second constraint plate 12 in this example. The interior surface around the outer periphery of the first constraint plate 11 is in opposing contact with the axial end face of the annular frame member 18. The first and second constraint plates 11, 12 are rotatably engaged with each other by this opposing contact as well as the engagement of the pawls 17*a*, 17*b* with the periphery of the circular hole 16. The connecting portion 14 serves also as a rotary shaft in this example. It is seen that the diameter of the first constraint plate 11 is rendered slightly smaller than the outer the diameter of the annular frame member 18. The end face of the annular frame member 18 is formed around its outer periphery integrally with a circular rim 19 such that the outer peripheral surface of the first constraint plate 11 is in sliding contact with the inner peripheral surface of the circular rim 19, which also acts to prevent the first and second constraint plates 11 and 12 from being diametrically offset with respect to the center of axis. As shown in FIGS. 4 and 5, the outer peripheral surfaces of the coupling shaft segments 15*a*, 15*b* are configured to form a part of a cylindrical surface concentric with the center of axis of the first constraint plate 11.

As shown in FIGS. 2, 5 and 6, reel shaft segments 21*a*, 21*b* extend up integrally from the interior surface of the first constraint plate 11 outside of the coupling shaft segments 15*a* and 15*b*, respectively. These reel shaft segments 21*a*, 21*b* are adapted to wrap a cording about the axis of those shaft segments. To that end, the outer peripheral surfaces of the reel shaft segments 21*a*, 21*b* have substantially cylindrical portions 22*a*, 22*b* lying on a cylindrical surface concentric with the center of axis of the first constraint plate 11. One ends of the substantially cylindrical portions 22*a*, 22*b* of the outer peripheral surfaces circumferentially opposite from each other terminate at the cording insertion slot 13 while the other ends of the substantially cylindrical portions 22*a*, 22*b* join the gently curved surfaces 23*a*, 23*b* which extend through an arc with as large a radius as possible from the point of intersection between the diametrically opposite ends 14*a*, 14*b* of the connecting portion 14 and the cording insertion slot 13 and smoothly continue into the substantially cylindrical portions 22*a*, 22*b*. That is, the curved surfaces 23*a*, 23*b* have a gentler degree of bend or curvature as compared to the angle formed between the reel shaft segments 21*a*, 21*b* and the cording insertion slot 13 where the circumferential end faces of the reel shaft segments 21*a*, 21*b* adjoin the cording insertion slot 13 so that a cording may be gently wrapped around the reel shaft segments 21*a*, 21*b*.

Figure 7:
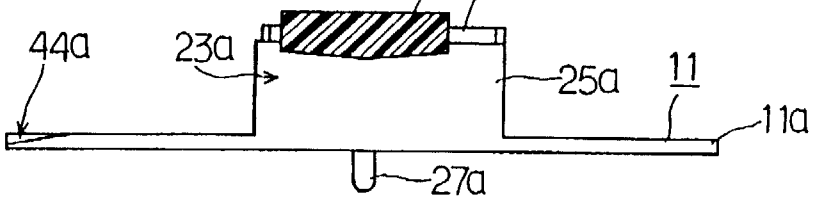
FIG. 7 is a cross-sectional view taken along the line B—B in FIG. 5.
Figure 8:
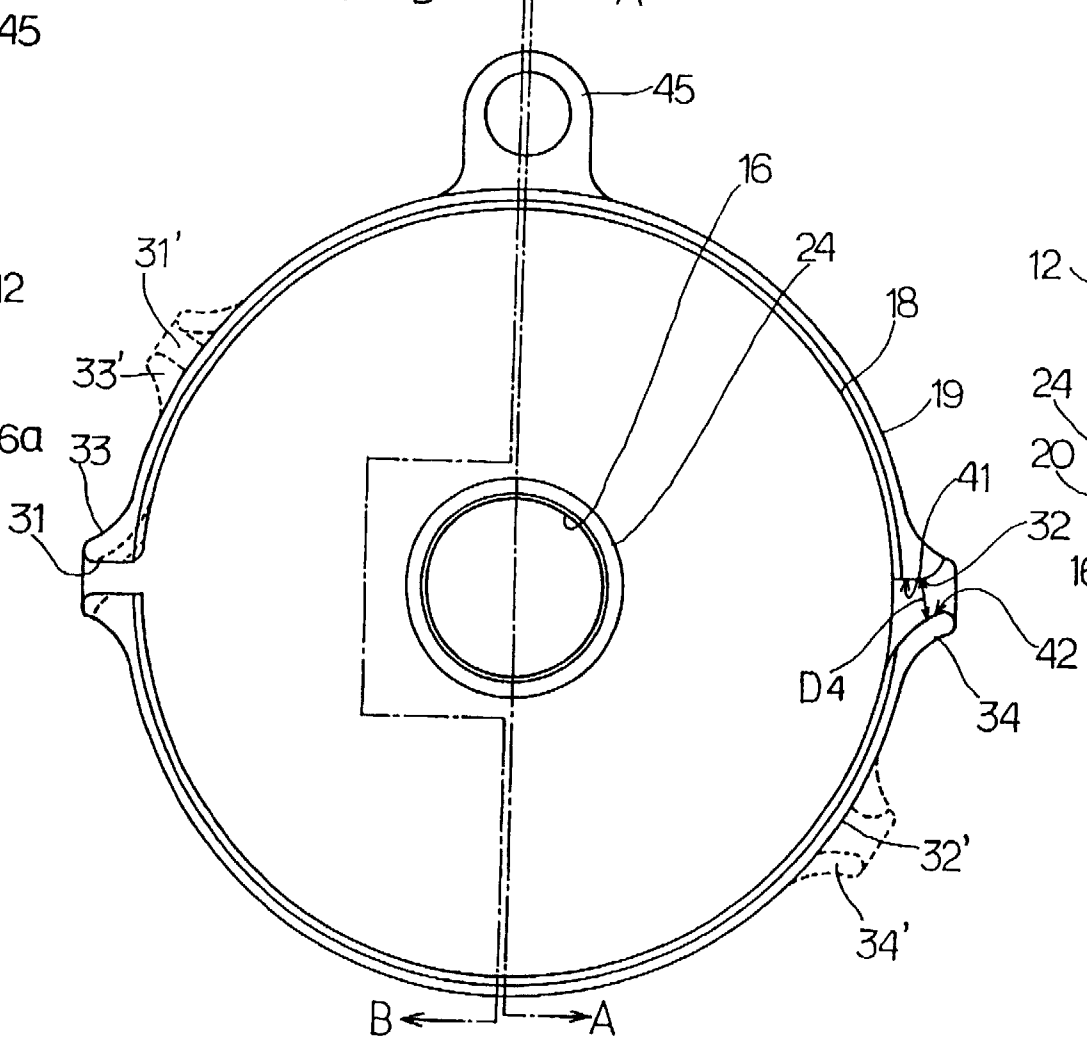
FIG. 8 is a front view illustrating a portion including the second constraint plate 12 in FIG. 1.

As described above, that portion of the second constraint plate 12 through which the circular hole 16 is formed has the recess 20 slightly indented from the exterior surface of the second constraint plate 12. To form the recess 20, a circular boss 24 is formed integrally with the interior surface of the second constraint plate 12 in the center thereof as shown in FIGS. 2, 8 and 9. The inner peripheral surfaces of the reel shaft segments 21*a*, 21*b* are engaged in sliding contact with the outer peripheral surface of the circular boss 24, whereby these two also serve as a shaft and a bearing for relative rotation of the first constraint plate 11 and the second constraint plate 12. It is also seen in FIG. 2 that while the substantially cylidrical portions of the axial end faces of the reel shaft segments 21*a*, 21*b* are engaged in sliding contact with the interior surface of the second constraint plate 12, the axial end faces of the gently curved surfaces 23*a*, 23*b* of the reel shaft segments 21*a*, 21*b* project from the first constraint plate 11 to a less extent so than those of the rest of the shaft segments so as not to be interfered with by the circular boss 24 as shown in FIG. 7. Further, the reel shaft segments 21*a*, 21*b* are connected at the ends circumferentially opposite from the gently curved surfaces 23*a*, 23*b* integrally with the connecting portion 14 by reinforcing portions 25*a*, 25*b* having the same height as the curved surfaces 23*a*, 23*b* so that they are also integrated with the first constraint plate 11, whereby the reel shaft segments 21*a*, 21*b* cooperate with the corresponding legs of the connecting portion 14 and the reinforcing portions 25*a*, 25*b* to define generally semi-cylindrical bodies, respectively to thereby increase mechanical strength.

Figure 10:
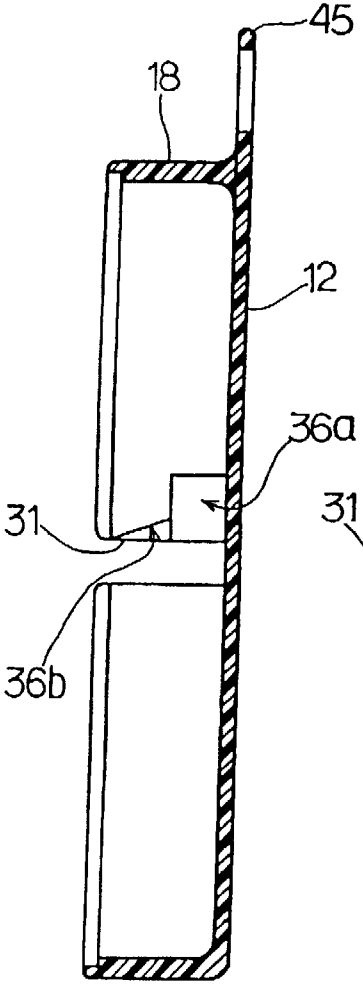
FIG. 10 is a cross-sectional view taken along the line B—B in FIG. 8.
Figures 11A, 11B:
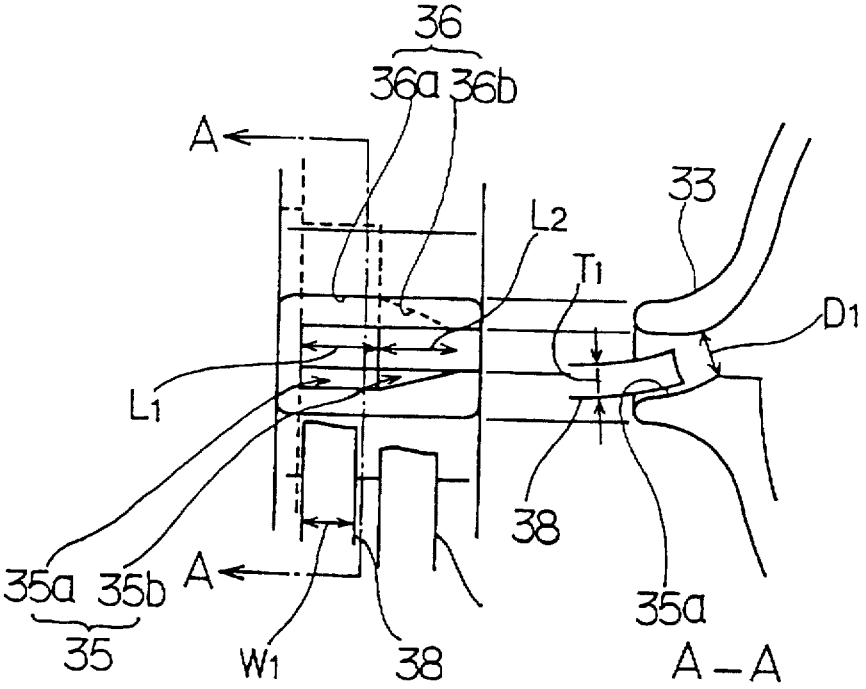
FIG. 11A is a right side view illustrating a portion in the vicinity of the inlet/outlet 31 in FIG. 8.
Fig. 11B is a cross-sectional view taken along the line A—A in FIG. 11A.

As shown in FIGS. 1 and 2, turning tabs 27*a*, 27*b* project integrally from the exterior surfaces of the respective plate sections 11*a*, 11*b* of the first constraint plate 11 so as to extend radially with respect to the center of the constraint plate. In this example, the turning tabs 27*a*, 27*b* lie on a line intersecting generally orthogonally with the cording insertion slot 13. As shown in FIGS. 1–3 and 8–10, the annular frame member 18 is formed with cording inlet/outlets 31, 32 on opposite sides of the center of the annular frame member 18. While the inlet/outlets 31, 32 both extend axially from one end face of the frame member, one inlet/outlet 31 is formed in the shape of a channel reaching the second constraint plate 12 as shown in FIG. 10 whereas the other inlet/outlet 32 terminates approximately at the midpoint of the width of the annular frame member 18 as shown in FIG. 9. As seen in FIGS. 1 and 8, these inlet/outlets 31, 32 have integral guide portions 33, 34, respectively extending radially outwardly therefrom. With the opposite ends of the cording insertion slot 13 placed in communication with the inlet/outlets 31, 32 as shown in FIG. 1, one guide surface 35 of the guide surfaces defining the guide portion 33 has one half section 35*a* toward the second constraint plate 12 slanted with respect to the direction of extension of the cording insertion slot 13 so as to widen the inlet/outlet whereas the other half section 35*b* of the guide surface 35 remote from the second constraint plate 12 is slanted so as to narrow the inlet/outlet as it approaches the first constraint plate 11 widthwise of the annular frame member 18 while at the same time it is slanted with respect to the direction of extension of the cording insertion slot 13 like the half section 35*a*, as illustrated in FIGS. 1, 2, 8, 11*A* and 11*B*. As shown in FIGS. 10 and 11, the other guide surface 36 has one half section 36*a* toward the second constraint plate 12 aligned in line with the direction of extension of the cording insertion slot 13 whereas the other half section 36*b* of the guide surface 36 remote from the second constraint plate 12 is slanted so as to go away from the guide surface 35 as it approaches the second constraint plate 12 widthwise of the annular frame member 18. When the cording to be reeled in is in the form of a ribbon, the lengths $L_1$, $L_1$ and $L_2$, $L_2$ of the guide surface half sections 35*a*, 35*b* and 36*a*, 36*b* as measured widthwise of the annular frame member 18 are made slightly greater than the width $W_1$ of the cording 38 while the spacing $D_1$ between the guide surfaces 35 and 36 of the inlet/outlet 31 defined by the guide portion 33 is less than the width $W_1$ of the cording 38 and greater than the thickness $T_1$ of the cording. The spacing $D_2$ between the first and second constraint plates 11, 12 is equal to $L_1+L_2$.

As shown in FIGS. 1, 3 and 9, the other guide portion 34 comprises guide surfaces 41, 42 adapted to guide the cording 38. One guide surface 41 has a radially inner section extending parallel to the direction of extension of the cording insertion slot 13 and a radially outer section so curved as to widen the guide portion 34, hence the inlet/outlet 32. The other guide surface 42 is slanted so as to go away from the direction of extension of the cording insertion slot 13 as it extends radially inwardly from its outer projecting end. The distance $D_3$ from the second constraint plate 12 to the inlet/outlet 32, hence the guide portion 34 is about equal to the width $W_1$ of the cording 38. The minimum spacing $D_4$ between the guide surfaces 41 and 42 is less than the width $W_1$ of the cording 38 and greater than the thickness $T_1$ of the cording. It is to be noted that the guiding directions of the guide portions 33, 34 are related with the reel shaft segments 21*a*, 21*b* such that with the opposite ends of the cording insertion slot 13 aligned with, that is, placed in communication with the inlet/outlets 31, 32, the curved surface 23*a* of the reel shaft segment 21*a* is closer to the guide surface 35 than to the guide surface 36 when the curved surface 23*a* is positioned toward the inlet/outlet 31, and the curved surface 23*a* is closer to the guide surface 41 than to the guide surface 42 when the curved surface 23*a* is positioned toward the inlet/outlet 32.

The exterior surface of the first constraint plate 11 is marked with arrows 43 for indicating the direction of rotation in which to rotate the first constraint plate 11. This direction of rotation is the direction in which the curved surface 23*a* of the reel shaft segment 21*a* is moved toward that end of the reel shaft segment 21*b* opposite from the curved surface 23*b*, which is the direction along the guiding direction of the guide portions 33, 34. As illustrated in FIGS. 5–7, the interior surface of the first constraint plate 11 at the opposite ends of the cording insertion slot 13 on the side of the corresponding curved surfaces 23*a* and 23*b* of the reel shaft segments 21*a* and 21*b* are slightly bevelled to form tapered surfaces 44*a* and 44*b*. An extension in the form of a tongue extends from the second constraint plate 12 in a plane of that plate to define a hanger lug 45 having a hole. It should be understood that the formation as shown in FIGS. 5–7 may be made as a monolithic molded part of synthetic resin. Likewise, the formation as shown in FIGS. 8–11 may be made as a monolithic molded part of synthetic resin.

Figure 12A:
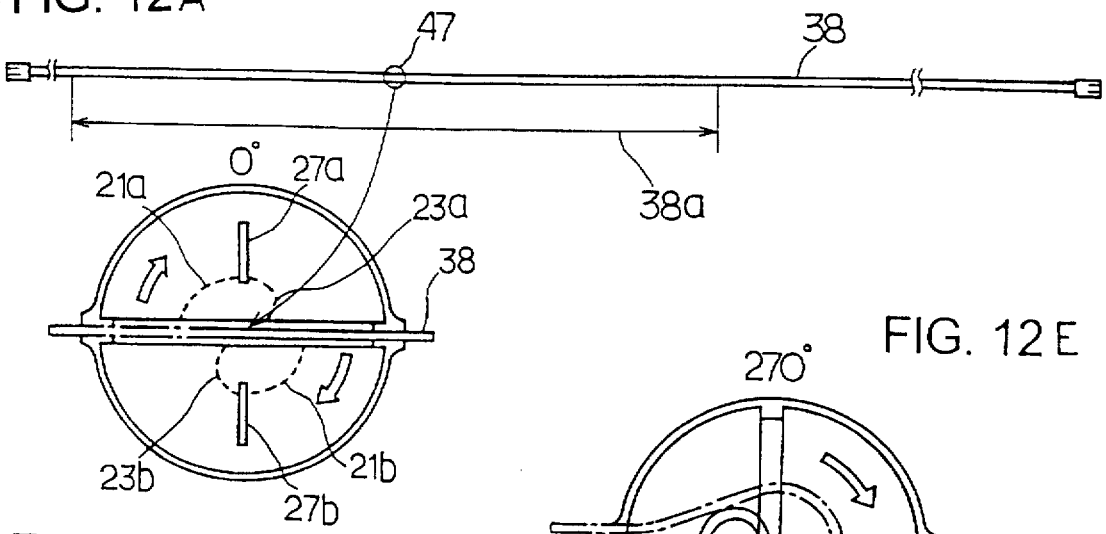
FIG. 12A is a plan view illustrating a cording and the cording being loaded in the first embodiment.
Figure 12B:
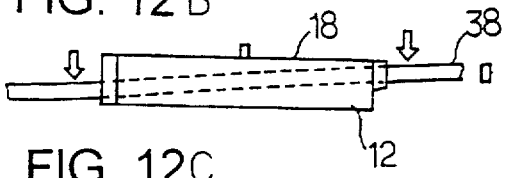
FIG. 12B is a front view of the drawing of FIG. 12A.

When it is desired to reel up a cording 38 such as a telephone modular cord into the reel device as described herein above, while holding the annular frame member 18 by one hand, the user rotates the turning tabs 27*a*, 27*b* by the other hand until the opposite ends of the cording insertion slot 13 are brought into alignment with the inlet/outlets 31, 32 as shown in FIG. 12A whereupon the telephone modular cord 38 is inserted into the cording insertion slot 13 such that the midpoint 47 of that portion 38*a* of the cord 38 that is desired to be reeled in coincides with the midpoint of the cording insertion slot 13. At this time, as illustrated in FIG. 12B, the cord 38 is generally in contact with the second constraint plate 12 on the side of inlet/outlet 31 while it lies on the interior surface of the first constraint plate 11 on the side of inlet/outlet 32.

Figure 12C:
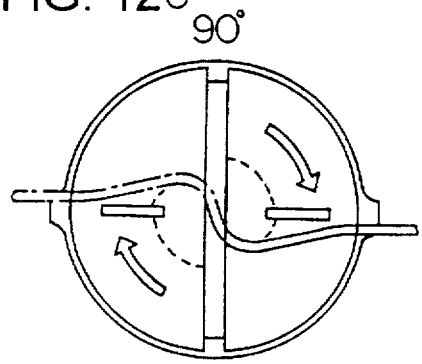
FIGS. 12C–12F are plan views sequentially illustrating the manner in which the cording is wound up from the state of FIG. 12A as the first constraint plate is rotated.
Figure 12D:
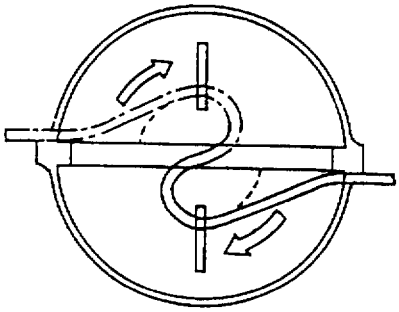
Figure 12E:
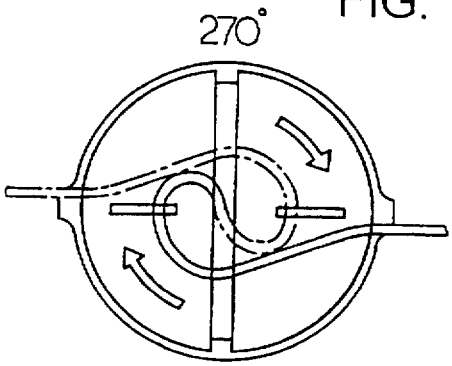
Figure 12F:
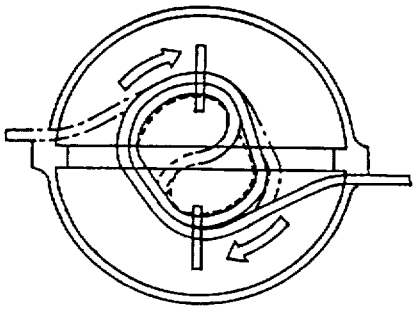
Figure 12G:
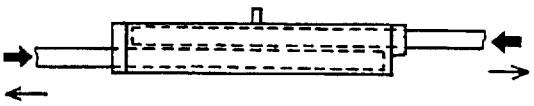
FIG. 12G is a front view of the drawing of FIG. 12F.
Figure 14:
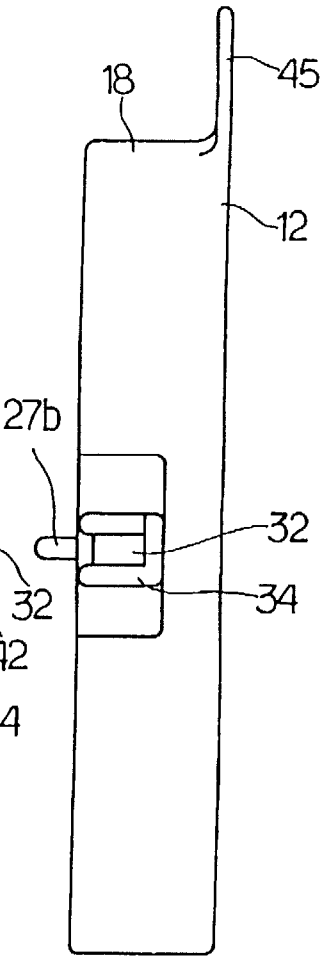
FIG. 14 is a side view seen from the right side of the drawing of FIG. 13.
Figure 13:
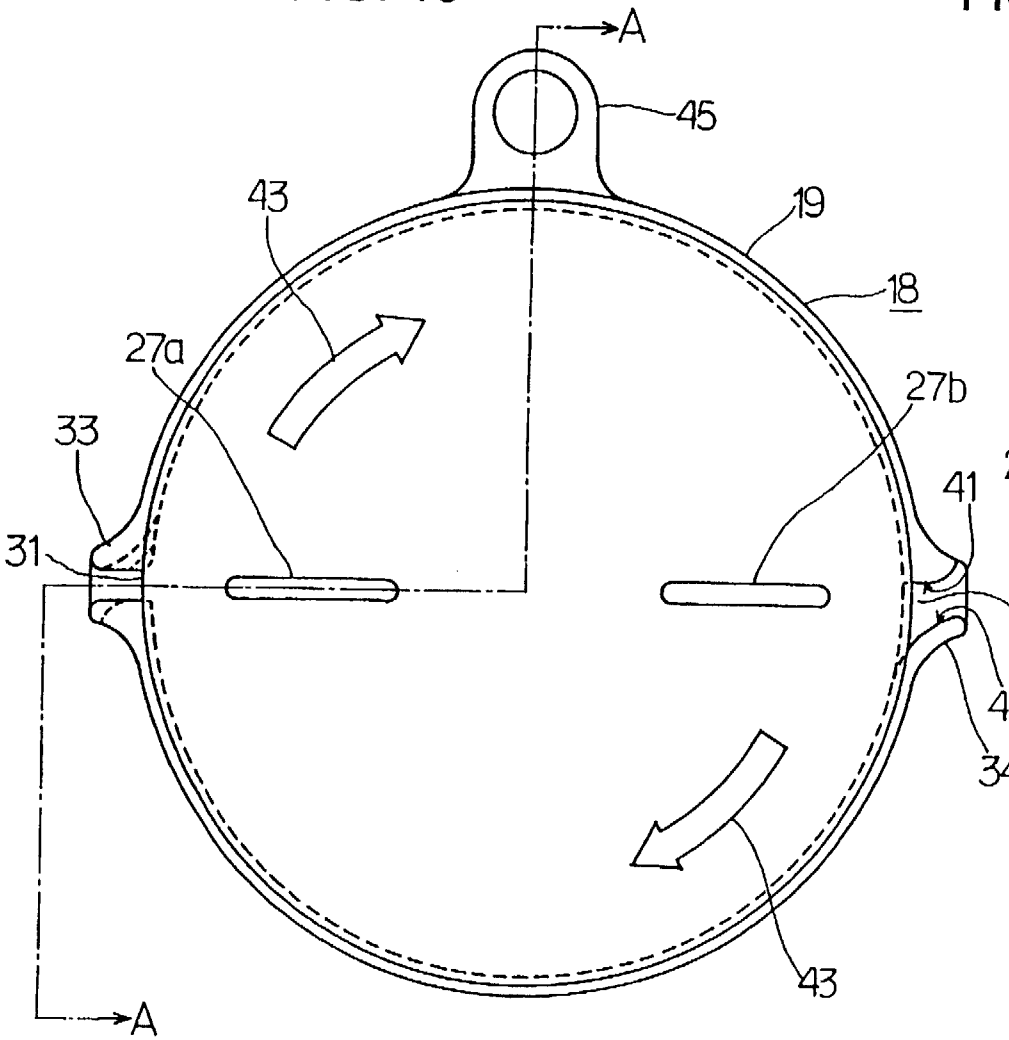
FIG. 13 is a front view illustrating an embodiment of the second aspect of the invention.
Figure 15:
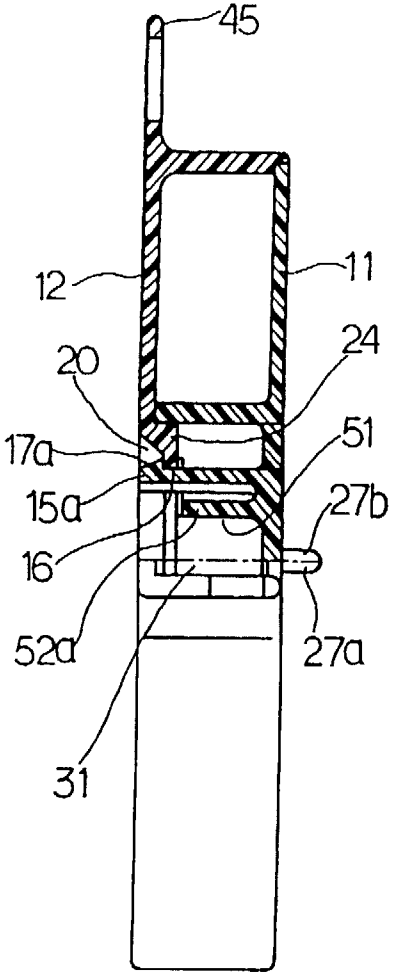
FIG. 15 is a cross-sectional view taken along the line A—A in FIG. 13.
Figure 16:
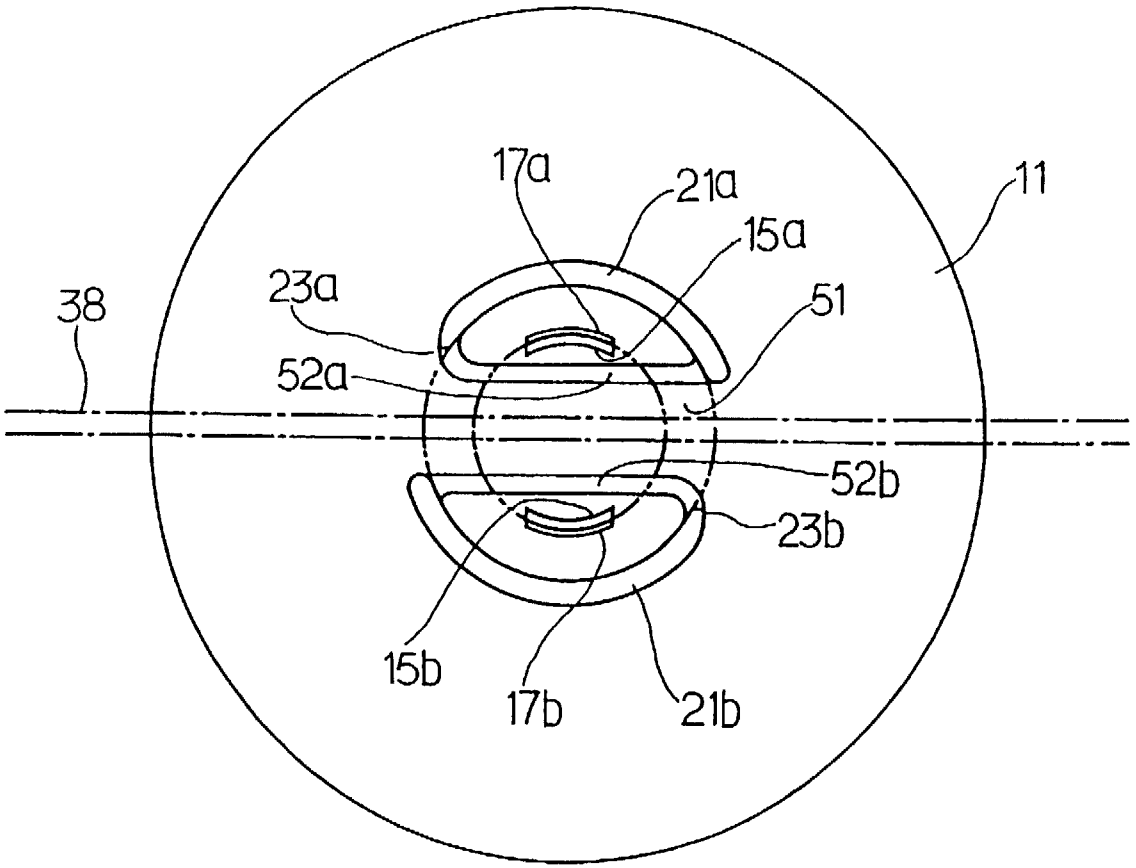
FIG. 16 is a rear view illustrating a portion including the first constraint plate 11 in FIG. 13.

Then, as the first constraint plate 11 is rotated by the use of the turning tabs 27*a*, 27*b* relative to the second constraint plate 12, the sections of the portion 47 being reeled in of the cord 38 on the opposite sides of the midpoint 47 are wrapped around the reel shaft segments 21*a* and 21*b* starting with the respective curved surfaces 23*a* and 23*b* as illustrated in FIGS. 12C and 12D. Once the rotation of the first constraint plate 11 has exceeded about one half (180°), the opposite sections of the cord 38 are wrapped around the reel shaft segments 21*a*, 21*b* with those segments as an axis of rotation as shown in FIGS. 12E and 12F. It is to be appreciated that the section of the cord on the side of inlet/outlet 31 is wound up on the side of first constraint plate 11 while the section of the cord on the side of inlet/outlet 32 is wound up on the side of second constraint plate 12, that is, automatically in two layers of the cord, as illustrated in FIG. 12G.

When it is desired to withdraw the cord 38, the opposite sections of the cord protruding out of the inlet/outlets 31 and 32, respectively may only need be pulled away from each other. In reeling in and reeling out the cord 38 as described above, the cord 38 is prevented from being bent at a sharp angle by the presence of the curved surfaces 23*a*, 23*b* and consequently will be hardly subject to deterioration even after repeated reeling-in and reeling-out operations, and the guide portions 33, 34 provide for smooth reeling-in and reeling-out as they guide the cord in the reeling-in and reeling-out directions. In addition, during the reeling-in operation, the cord 38 on the side of inlet/outlet 31 is guided toward the second constraint plate 12 by the slanted surfaces 35*b*, 36*b* of the guide portion 33 while the cord on the side of inlet/outlet 32 is guided toward the first constraint plate 11 due to the inlet/outlet 32 being spaced apart from the second constraint plate 12, resulting in the cord being wound up in two layers, one adjacent the second constraint plate 12 and the other adjacent the first constraint plate 11. This allows for reeling in the cord more closely. Although the telephone modular cord is in the form of a ribbon, both the minimum spacing $D_1$ between the guide surfaces 35*a* and 36*a* and the minimum spacing $D_4$ between the guide surfaces 41 and 42 are less than the width $W_1$ of such cord and greater than the thickness $T_1$ of the cord, whereby the cord 38 is necessarily reeled up in two layers stacked widthwise one over another without being folded on itself. If the tapered surfaces 44*a*, 44*b* are formed on the first constraint plate 11 at the opposite ends of the cording insertion slot 13, they will prevent the cord 38 from being deviated toward the exterior surface of the first constraint plate 11 and aid in reeling the cord inwardly.

In the example described above in which the first and second constraint plates 11, 12 are rotatably coupled together by the use of the coupling shaft segments 15*a*, 15*b*, the first and second constraint plates 11, 12 may be separated by resiliently deforming the ends of the coupling shaft segments 15*a*, 15*b*, toward each other out of engagement with the periphery of the circular hole 16. It is to be understood, however, that the means for coupling the first and second constraint plates 11, 12 for relative rotation need not necessarily be limited to the coupling shaft segments 15*a*, 15*b* and that the first and second constraint plates need not necessarily be separably coupled. By way of example, the first and second constraint plates 11, 12 may be rotatably coupled together by means of the annular frame member 18.

An embodiment of the second aspect of the invention will now be described with reference to FIGS. 13–16 in which those components corresponding to those in Figs. 1–11 are indicated by the like reference numerals. In this second aspect of the invention, a first constraint plate 11 and a second constraint plate 12 are separable from each other and relatively rotatable To this end, the coupling of the coupling shaft segments 15*a*, 15*b* with the periphery of the circular hole 16 is effected in the same manner as in the embodiment of the first aspect of the invention. This second aspect of the invention is different from the first aspect of the invention in that the first constraint plate 11 is not formed with a cording insertion slot 13, and hence it is not divided into two plate sections with the connecting portion 14 omitted. Instead, a cording insertion means 51 is provided between the reel shaft segments 21*a* and 21*b*. In this embodiment, the opposite circumferential ends of the reel shaft segments 21*a* and 21*b* are connected together by respective reinforcing portions 52*a*, 52*b* so as to define generally semi-cylindrical configurations, respectively. These reinforcing portions 52*a*, 52*b* are integrated with the first constraint plate 11 and have such a height as not to be interfered with by the circular boss 24. The reinforcing portions 52*a*, 52*b* are parallel to each other and define the cording insertion means 51 therebetween. Turning tabs 27*a*, 27*b* are provided on the exterior surface of the first constraint plate 11 so as to lie generally on the central line of the cording insertion means 51. This embodiment is similar to the embodiment of FIGS. 1–11 except for the foregoing Thus, the second constraint plate 12 and the annular frame member 18 are entirely the same in configuration as those illustrated in FIGS. 8–10.

When it is desired to wind up a cording 38 into the reel device according to the embodiment of the second aspect of the invention, the user separates the first constraint plate 11 from the second constraint plate 12 by disengaging the pawls 17*a*, 17*b* from the circular hole 16. The user then places the cording 38 in the cording insertion means 51 as shown by dotted lines in FIG. 16. If the cording is similar to the example illustrated in FIG. 12, the user positions the midpoint 47 of the cording in the cording insertion means 51. Then, the first constraint plate 11 and the second constraint plate 12 are coupled together by resiliently deforming and pushing the axial end portions of the coupling shaft segments 15*a*, 15*b* into the circular hole 16. At this time those sections of the cording 38 on the opposite sides of the cording insertion means 51 are positioned in the inlet/outlets 31 and 32, respectively with the section of the cording 38 contacting the second constraint plate 12 on the side of inlet/outlet 31. In this state, as with the previously described embodiment, if the first constraint plate 11 is rotated relative to the second constraint plate 12 in the direction shown by the arrows 43, the opposite sections of the cording 38 are wrapped around the reel shaft segments 21*a*, 21*b* in two layers stacked one over the other.

In order to facilitate the engagement of the pawls 17*a*, 17*b* with the circular hole 16, the outer surfaces of the pawls 17*a*, 17*b* are tapered such that during the coupling operation, forcing the first constraint plate 11 toward the second constraint plate 12 with the tapered surfaces in contact with the peripheral edge of the circular hole 16 will resiliently deform the coupling shaft segments 15*a*, 15*b* to easily permit the coupling. In this embodiment, if the turning tabs 27*a*, 27*b* are located such that their direction of extension is in alignment with the inlet/outlets 31, 32, the direction of extension of the cording insertion means 51 will be in coincidence with the line connecting the inlet/outlets 31 and 32, whereby the opposite sections of the cording 38 may be easily positioned in the inlet/outlets 31 and 32, respectively. The provision of the reinforcing portions 52*a*, 52*b*, if they are provided, will not only increase the mechanical strength of the reel shaft segments 21*a*, 21*b*, but also serve to prevent the possibility of the coupling shaft segments 15*a*, 15*b* being broken when the pawls 17*a*, 17*b* are moved toward each other by the user's finger tips to disconnect the first constraint plate 11 from the second constraint plate 12 since the reinforcing portions 52*a*, 52*b* act to as stop means to limit excessive displacement of the pawls 17*a*, 17*b*. Moving the pawls 17*a* and 17*b* toward each other to an excessive extent would possibly break the coupling shaft segments 15*a*, 15*b*.

Figure 17:
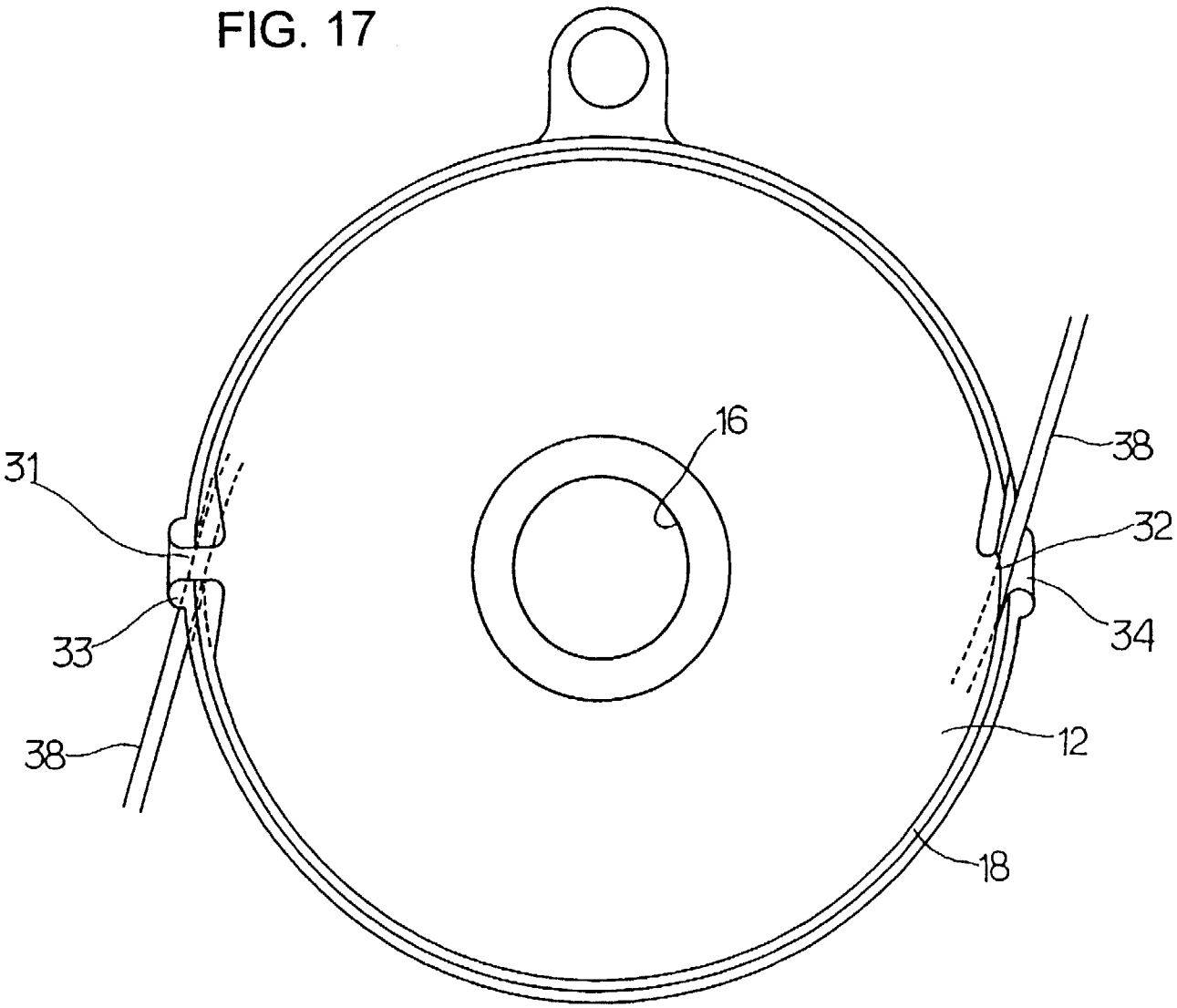
FIG. 17 is a front view illustrating another form of the portion including the second constraint plate 12.

For use with a relatively stiff cording 38, it is advantageous for facilitating the reeling-in of the cording that the guide portions 33 and 34 at the inlet/outlets 31 and 32, respectively be configured so as to take in the cording along the inner peripheral surface of the annular frame member 18 in the direction of reeling the cording around the reel shaft segments 21*a*, 21*b* (not shown), as illustrated by dotted lines in FIG. 17, for example. Alternatively, as illustrated by dotted lines in FIG. 8, additional inlet/outlets 31' and 32' and associated guide portions 33' and 34' may be added so that the inlet/outlets 31, 32 and the inlet/outlets 31', 32' may be selectively used depending upon the thickness of cording 38. The first and/or second constraint plates 11, 12 may be formed with heat dissipation holes, if required. The annular frame member 18 may be formed integrally with the first constraint plate 11 instead of the second constraint plate. For use with a relatively pliable cording, the guide portion 33 alone may be provided to allow for reeling in the cording in two layers stacked one on the other, with the other guide portions 34 eliminated, and each of the reel shaft segments 21*a* and 21*b* may be entirely in the form of a part of a cylinder with the curved surfaces 23*a*, 23*b* eliminated. If it is not required to reel up a cording densely, the means for providing for winding the cording in two layers may also be omitted. In other words, the inlet/outlets 31 and 34 may be of the same shape. In order to increase the mechanical strength of the coupling shaft segments 15*a*, 15*b*, it is desirable to have their outer peripheries lie on the same cylindrical surface generally aligning with the peripheral surface of the circular hole.

As discussed above, this invention is applicable to a cording such as telephone modular cords, ear phone cords, power cords for various electronic appliances, cables made up of a bundle of signalling cords and power lines, and other lines, strings and the like unconnected with electric appliances, and allows for reeling up a portion of such cording intermediate between its opposite ends into the reel device of this invention in an extremely simple operation, whereby the cording may be shortened to a minimum required in length with no surplus length of the cording extending around, and yet the reeled-in cording may be easily be reeled out or removed as required.

Especially, it should be noted that the two-layer winding is realized to permit a ribbon-like cording to be reeled up highly densely by providing two diametrically opposed inlet/outlets having different lengths as measured axially of the reel device.

The device according to any aspect of this invention may be fabricated by assembling two parts both of which may be made as molded parts of resin at an extremely low cost.

I claim:

1. A cording reel device comprising:

a first constraint plate divided by a cording insertion slot into two substantially equal halves which are integrally connected together by a connecting portion of U-shaped cross section, a pair of reel shaft segments attached integrally to the interior surface of said first constraint plate on opposite sides of said connecting portion, a second constraint plate coupled in opposed facing relation with the first constraint plate for relative rotation about said connecting portion, and an annular frame member interposed between and generally along outer peripheries of said first and second constraint plates and affixed integrally to one of said constraint plates, said annular frame member being formed with first and second inlet/outlets on opposite sides of said connecting portion for introducing and withdrawing a cording therethrough into and out of said device, said first inlet/outlet being formed as spanning said first and second constraint plates, and said second inlet/outlet being formed as extending from the other of said constraint plates to which said annular frame member is not affixed to approximately the midpoint of the spacing between said first and second constraint plates.

2. A cording reel device comprising:

a first constraint plate, a pair of opposed coupling shaft segments having their one ends connected integrally with and extending up from the interior surface of said first constraint plate at its central portion, a pair of reel shaft segments having their one ends connected integrally with the interior surface of said first constraint plate outside of the respective coupling shaft segments, a second constraint plate disposed in opposed relation with said first constraint plate and detachably and rotatably coupled with the other ends of said pair of coupling shaft segments, and an annular frame member interposed between and generally along the outer peripheries of said first and second constraint plates and affixed integrally to one of the constraint plates, said annular frame member being formed with first and second inlet/outlets for introducing and withdrawing a cording into and out of said device on opposite sides of said coupling shaft segments.

3. The cording reel device according to claim 2, wherein said first inlet/outlet is formed as spanning said first and second constraint plates while said second inlet/outlet is formed as extending from the other of said constraint plates to which said annular frame member is not affixed to approximately the midpoint of the spacing between said first and second constraint plates.

4. The cording reel device according to claim 1 or 3, wherein said first inlet/outlet is formed with guide surfaces for guiding a cording from that one of said constraint plates to which the second inlet/outlet is adjoining to the other of said constraint plates.

5. The cording reel device according to claim 4, wherein said first and second inlet/outlets are formed with inner guide surfaces adapted to guide a cording in the same direction of winding generally about the center of relative rotation of said first and second constraint plates.

6. The cording reel device according to claim 5, wherein said first and second inlet/outlets have respective integral guide extensions in communication therewith and extending outwardly therefrom for guiding the introduction and withdrawal of the cording into and out of said device.

7. The cording reel device according to claim 4, further comprising at least one turning tab for use to effect relative rotation of said first and second constraint plates, said at least one turning tab being integrally with the exterior surface of the constraint plate to which said annular frame member is not affixed.

8. The cording reel device according to claim 7, wherein said turning tab extends radially with respect to the center of said relative rotation and coincides generally with a straight line passing through the middle between said coupling shaft segments.

9. The cording reel device according to claim 4, wherein the minimum passage width of said first and second inlet/outlets is smaller than one half of the spacing between said first and second constraint plates.

10. The cording reel device according to claim 4, wherein said annular frame member is formed integrally with said second constraint plate.

11. A cording reel device comprising:

a first constraint plate divided by a cording insertion slot into two substantially equal halves which are integrally connected together by a connecting portion of U-shaped cross section, a pair of reel shaft segments attached integrally to the interior surface of said first constraint plate on opposite sides of said connecting portion a second constraint plate coupled in opposed facing relation with the first constraint plate for relative rotation about said connecting portion, an annular frame member interposed between and generally along outer peripheries of said first and second constraint plates and affixed integrally to one of said constraint plates, said annular frame member being formed with first and second inlet/outlets on opposite sides of said connecting portion for introducing and withdrawing a cording therethrough into and out of said device, and a pair of coupling shaft segments extending up integrally from the interior surface of said first constraint plate between said connecting portion and the corresponding reel shaft segments, said second constraint plate being engaged with said coupling shaft segments for rotation about said coupling shaft segments.

12. The cording reel device according to claim 2 or 11, wherein said second constraint plate is formed with a central circular hole, said coupling shaft segments having integral pawls formed on the outer surfaces of their free ends, said pawls being configured to engage with the outer surfaces of the peripheral edge of said circular hole whereby said first and second constraint plates are rotatably engaged with each other, with the axial end face of said annular frame member in opposing contact with the interior surface of the constraint plate to which the annular frame member is not joined, said coupling shaft segments being deflectable to such an extent as to be able to be moved out of engagement with the peripheral edge of said circular hole.

13. The cording reel device according to claim 12, wherein the outer peripheral surfaces of said pair of reel shaft segments generally lie on the same cylindrical surface concentric with the center of relative rotation of said first and second constraint plates, said cording insertion slot being located between the opposed circumferential ends of said reel shaft segments.

14. The cording reel device according to claim 13, wherein one end portions of said pair of reel shaft segments which are not circumferentially opposed to each other have a degree of bend relative to said cording insertion slot that is less than the degree of bend of the other end portions of said reel shaft segments.

15. The cording reel device according to claim 14, wherein the exterior surface of the constraint plate to which said annular frame member is not affixed is marked with arrows for indicating the direction of rotation in which to rotate said first constraint plate so that the one end portion of one of said pair of reel shaft segments having the lesser degree of bend is moved away from the other end portion of the other opposing reel shaft segment.

16. The cording reel device according to claim 14, wherein the opposite ends circumferential of each of said reel shaft segments are connected together by a reinforcing portion so as to define generally a semi-cylindrical configuration, the respective reinforcing portions of said reel shaft segments being integrated with said first constraint plate.

17. The cording reel device according to claim 13, wherein the axial end faces of said reel shaft segments are in sliding contact with said second constraint plate.

18. The cording reel device according to claim 13, further comprising a circular boss integrally formed with the interior surface of said second constraint plate, and wherein the inner peripheral surfaces of said two reel shaft segments generally lie on the same cylindrical surface concentric with the center of said relative rotation, the inner peripheral surfaces of said two reel shaft segments being adapted to slidably contact the outer peripheral surface of said circular boss.

19. The cording reel device according to claim 18, wherein said circular boss is defined by indenting that portion of said second constraint plate through which said circular hole is formed from the exterior surface of the second constraint plate to form an indented recess in said exterior surface, said two pawls being positioned in said indented recess.

20. The cording reel device according to claim 12, further comprising stop means disposed on the opposed inner sides of said two coupling shaft segments for limiting movement of the coupling shaft segments toward each other, said stop means being formed integrally with the interior surface of said first constraint plate.

21. The cording reel device according to claim 11, wherein said coupling shaft segments have pawls affixed to the outer surfaces of their free ends, said pawls being configured to engage with the outer surfaces of the peripheral edge of a circular hole formed in said second constraint plate, the projecting end of said connecting portion being positioned in said circular hole, and the opposite ends of said connecting portion longitudinal of said cording insertion slot being in sliding contact with the peripheral surface of said circular hole.

22. A cording reel device comprising:

a first constraint plate divided by a cording insertion slot into two substantially equal halves which are integrally connected together by a connecting portion of U-shaped cross section, a pair of reel shaft segments attached integrally to the interior surface of said first constraint plate on opposite sides of said connecting portion, a second constraint plate coupled in opposed facing relation with the first constraint plate for relative rotation about said connecting portion, and an annular frame member interposed between and generally along outer peripheries of said first and second constraint plates and affixed integrally to one of said constraint plates, said annular frame member being formed with first and second inlet/outlets on opposite sides of said connecting portion for introducing and withdrawing a cording therethrough into and out of said device the exterior surface of said first constraint plate being marked with arrows for indicating the direction of rotation, and the interior surface of said first constraint plate being bevelled at the opposite ends of said cording insertion slot on the side opposite from said direction of rotation to form tapered surfaces.

* * * * *